United States Patent [19]

Herrmann, Jr.

[11] 4,417,736

[45] Nov. 29, 1983

[54] HIGH VOLTAGE RACK AND PANEL CONNECTOR

[75] Inventor: Henry O. Herrmann, Jr., Mt. Joy, Pa.

[73] Assignee: AMP Incorporated, Harrisburg, Pa.

[21] Appl. No.: 954,954

[22] Filed: Oct. 26, 1978

Related U.S. Application Data

[63] Continuation-in-part of Ser. No. 869,974, Jan. 16, 1978, abandoned.

[51] Int. Cl.[3] ..... H01R 13/52

[52] U.S. Cl. ..... 277/212 R; 339/60 M; 339/94 M

[58] Field of Search ..... 277/212, 212 FB, 212 C; 339/94, 60 M

[56] References Cited

U.S. PATENT DOCUMENTS 3,842,393 10/1974 Glover et al. ..... 339/60 M
3,850,495 11/1974 Glover ..... 339/60 M
3,901,518 8/1975 Uchida ..... 277/212 FB

FOREIGN PATENT DOCUMENTS 1123852 8/1968 United Kingdom ..... 277/207 A

*Primary Examiner*—Robert I. Smith
*Attorney, Agent, or Firm*—Russell J. Egan

[57] ABSTRACT

An improved sealing means is disclosed for use with high voltage rack and panel connectors. The subject sealing means is received in a cavity of a panel or ferrule member and forms a recess which closely receives a rigid portion of a mating rack or mate connector member. A further portion of the sealing means allows for some flow to compensate for misalignment of the rigid portions of the mating connector members due to inaccuracies resulting from practical molding processes and/or mounting configurations. The configuration of the seal assures that it will remain in the panel when the connector is unmated.

8 Claims, 8 Drawing Figures

HIGH VOLTAGE RACK AND PANEL CONNECTOR

CROSS REFERENCE TO RELATED APPLICATIONS

The present application is a continuation-in-part of application Ser. No. 869,974, filed Jan. 16, 1978, now abandoned.

BACKGROUND OF THE INVENTION

1. The Field of the Invention

The present invention relates to high voltage rack and panel connectors and in particular to an improved sealing means to be used in multiple terminal high voltage connectors.

2. The Prior Art

In the field of high voltage connectors there is a constant problem of providing adequate sealing between mating connector members to prevent corona from occuring as well as to prevent arcing in or around the connector. Examples of such connectors that have successfully provided sealing may be found in U.S. Pat. Nos. 3,842,393; 3,850,495; and 3,977,750. The present invention constitutes an improvement over these known connectors by providing compensation for some misalignment between mating connector members.

SUMMARY OF THE INVENTION

The present invention concerns a sealing means for high voltage multi-contact connectors with the sealing means being formed by a substantially cylindrical member of resilient material having at least one inwardly directed constriction and at least one relief recess on the exterior of the member so that good sealing may be accomplished between mating rigid connector housing members received in and receiving the tubular sealing member, while allowing some float for accommodating misalignment of the rigid housing members.

It is therefore an object of the present invention to produce an improved seal for high voltage connectors which seal will accommodate some misalignment of mating rigid housing members without losing the effective sealing thereof.

It also is an object of the present invention to produce an improved seal for high voltage connectors which will accommodate some misalignment of mating rigid housing members without losing the effective sealing thereof or requiring excessive engagement and disengagement forces.

It is another object of the present invention to produce an improved seal for high voltage electrical connectors which seal is of small dimenstions and yet provides effective sealing.

It is a further object of the present invention to produce an improved high voltage electrical connector seal which can be readily and economically produced.

The means for accomplishing the foregoing objects and other advantages will become apparent to those skilled in the art from the following detailed description taken with reference to the accompanying drawings.

DETAILED DESCRIPTION OF THE PREFERRED EMBODIMENT

Figure 1:
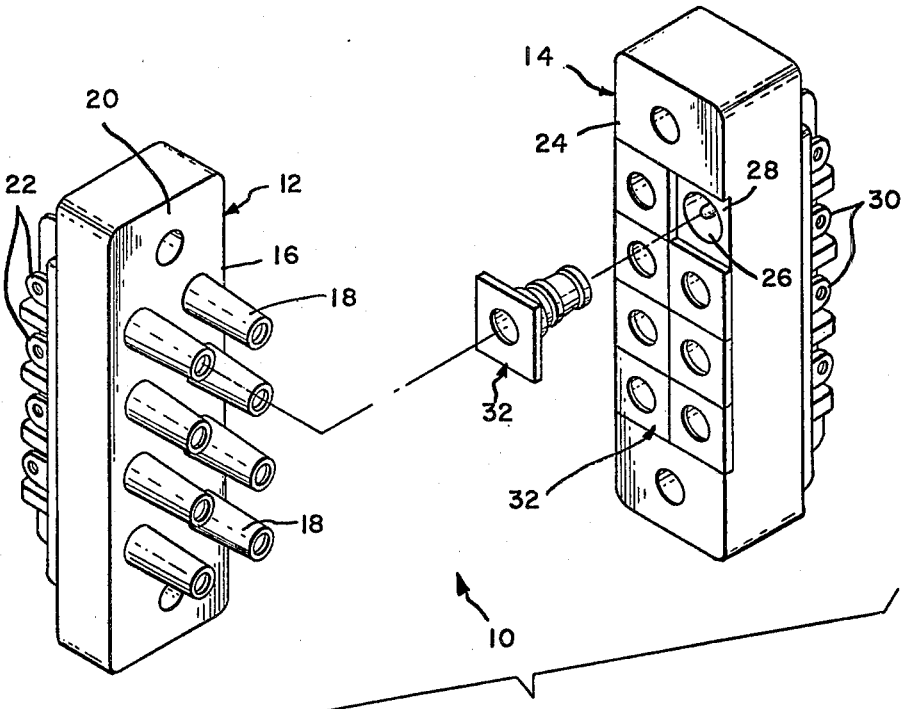
FIG. 1 is an exploded perspective view of mating high voltage rack and panel connector members and a first embodiment of the sealing means of the present invention.

The connector assembly 10 of FIG. 1 includes a rack or plug member 12 and a panel or receptacle member 14. The plug member 12 includes a housing 16 of rigid insulative material with a plurality of rigid tubular portions 18 extending from a mating face 20 thereof. A like plurality of female or socket electrical terminals 22 are mounted in the housing with a receptacle portion (see FIG. 2) of each terminal lying within the bore of the respective tubular portions 18. The mating panel or receptacle member 14 includes a housing member 24 of rigid insulative material having a plurality of cavities 26 opening in a mating face 28. A like plurality of male or pin terminals 30 are mounted in the housing each with a pin portion extending into a respective recess 26, as shown in FIG. 2.

The pin and socket terminals 30, 22, respectively, shown are merely representative of known electrical terminals. Any terminal capable of high voltage operation may be substituted for those illustrated without departing from the present invention which relates to the seal formed between the mating connector members rather than upon the particulars of either the terminals or overall connector configuration.

Figure 3:
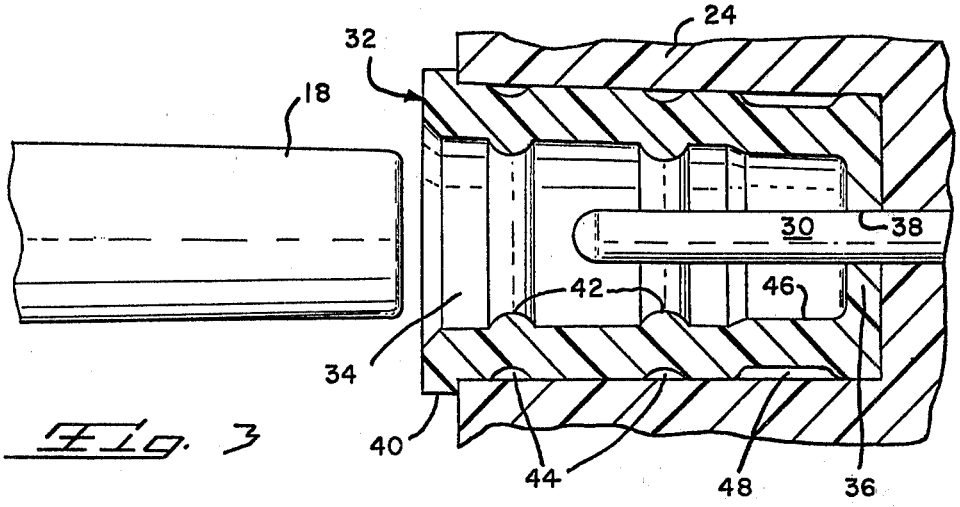
FIG. 3 is an enlarged detailed view, partially in section, showing a single sealing means with fragments of the connector members of FIGS. 1 and 2.
Figure 4:
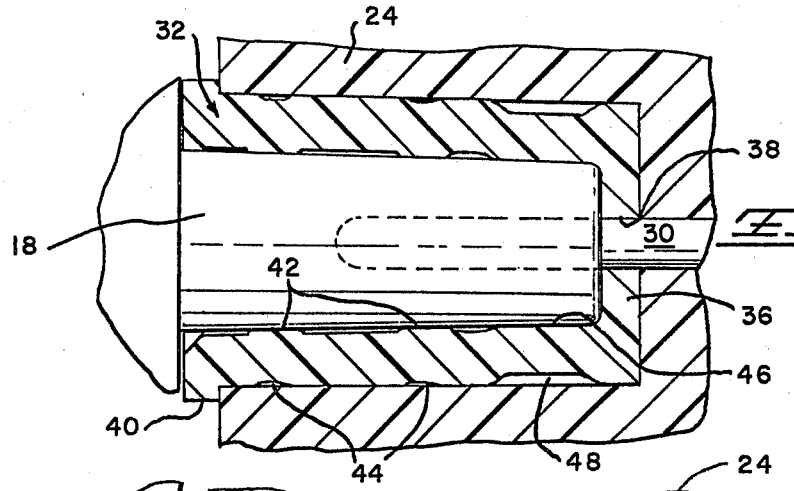
FIG. 4 is a detailed view, similar to FIG. 3, showing the sealing means with the housing members mated in a normal condition.
Figure 5:
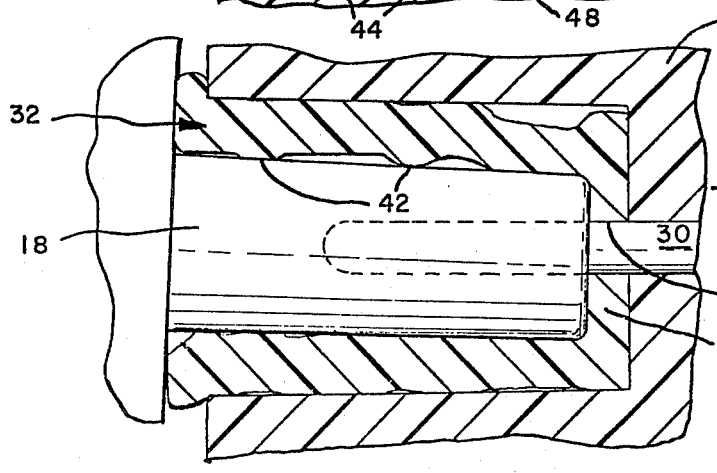
FIG. 5 is a detailed view, similar to FIGS. 3 and 4, showing the sealing means in an extreme condition of misalignment of the housing members.

The details of a first embodiment of the subject sealing means and its operation will be described with reference to FIGS. 3 to 5. The subject sealing means 32 comprises a substantially tubular unitary member having a blind bore 34 closed by a base 36 having an aperture 38 substantially centrally disposed therein to receive therethrough a respective pin portion of a terminal 30. The entrance to the bore 34 is surrounded by an outwardly directed flange 40 which engages the mating face 28 while the base 36 either lies closely adjacent to or rests against the base of the aperture 26. The bore 34 includes at least one annular restriction 42, each having a corresponding external annular relief recess 44. The inner end of the bore 34 has a portion 46 of lesser diameter than the remainder of the bore, with the exception of the annular restrictions 42. The portion 46 is matched on the exterior with a similar annular recess 48.

Figure 2:
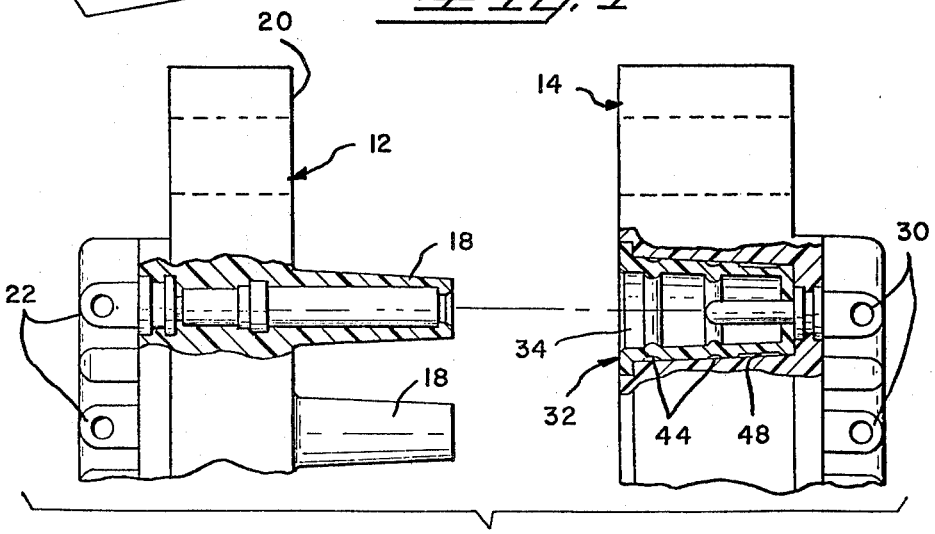
FIG. 2 is an exploded view, partially in section, showing the first embodiment of the subject sealing means assembled in the panel or receptacle member to receive mating rack or plug member of FIG. 1.

The subject seal 32 is positioned in a respective recess 26 of a panel or receptacle member 14 as shown in FIG. 2. The operation and functioning of the seal can be best seen from a comparison of FIGS. 3 to 5. In a normal unmated condition of the connector, the sealing means 32 effectively forms a seal between the walls of the recess 26 of the panel or receptacle member 14 with the base 36 tightly engaging the terminal 30 where it passes through aperture 38. When the rigid cylindrical portion 18 of the rack or plug member 12 is inserted in the blind bore 34 of the sealing means 32, the annular restrictions 42 tightly engage and grip the rigid member. The tight gripping causes the compression of the material of the sealing means, but a strain relief is provided by the annular recesses 44 to prevent damage to the sealing means material while maintaining effective sealing. The restricted diameter portion 46 expands to accommodate the end of the rigid member 18 and, due to the external recess 48, is able to accommodate some misalignment of the members by allowing a certain amount of flow of the seal material. A case of misalignment of the connector members is shown in an extreme condition in FIG. 5 with the sealing means 32 completely compressed against the wall of the recess 26 on the lower extremity and yet the sealing of both the exterior and interior is not diminished on the opposite side of the recess.

Figure 6:
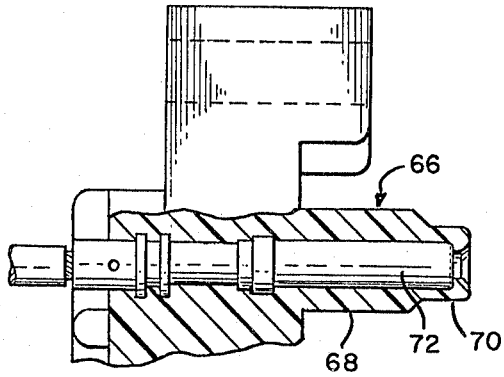
FIG. 6 is an exploded view, partially in section, showing an alternate embodiment of the subject sealing means assembled in a panel member to receive therein a modified mating rack member.
Figure 6:
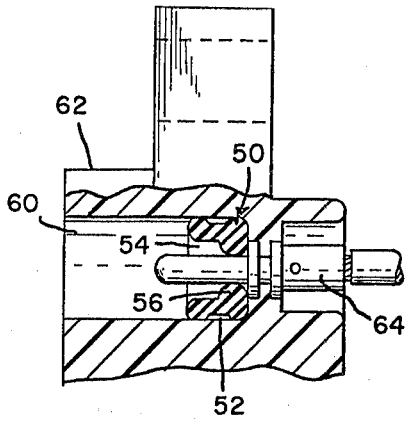
Figure 7:
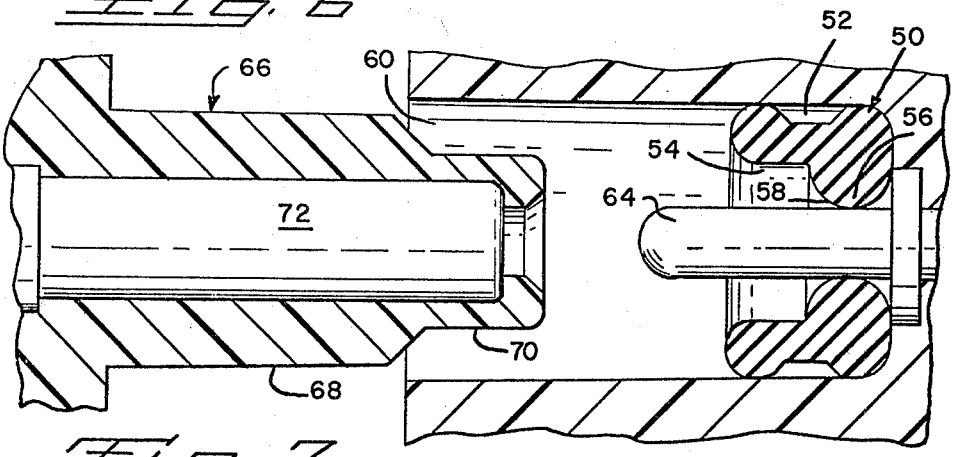
FIG. 7 is an enlarged detailed view, partially in section, showing the alternate embodiment of the subject sealing means with fragments of the connector members.
Figure 8:
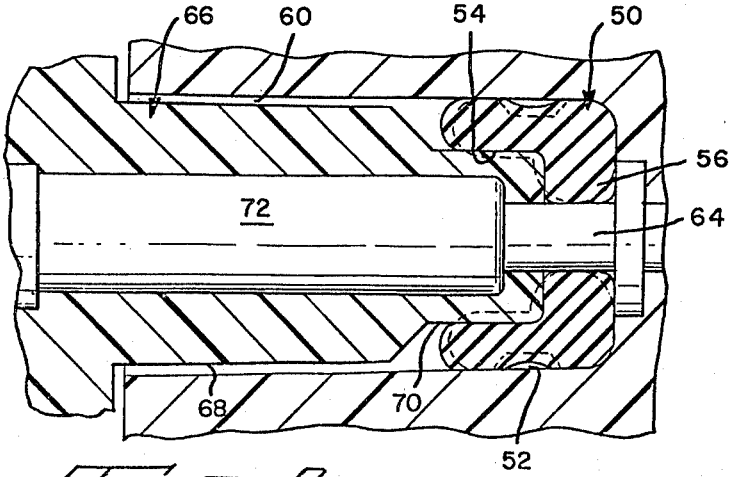
FIG. 8 is a detailed view, similar to FIG. 7, showing the alternate embodiment of the subject sealing means in a normal mated condition.

An alternate embodiment of the subject seal 50 is shown in FIGS. 6 to 8. The seal is a tubular member of resilient material and includes at least one annular recess 52 on the outer surface, an axial bore 54, a base 56 closing one end of the bore and a central aperture in the base. The seal is entirely received within a terminal bore 60 of a panel member 62 with a male or pin terminal 64 extending through the aperture 58.

The mating rack member 66 is formed of rigid material and has a plurality of tubular portions 68 extending therefrom to be received in bores 60 of the panel member 62. The portions 68 have a stepped outer profile which includes a nose 70 of lesser diameter than the rest of the portion. A receptacle terminal 72 is mounted in each tubular portion.

The base 56 of the seal 50 normally exerts sufficient force on the terminal 64 to keep the seal in place. When the connector members are mated, the nose 70 enters bore 54 and causes some deformation of the seal, as shown in FIG. 8. This deformation results in flow of the sealing material to more tightly engage the terminal 64 and the walls of bore 60 of the panel members. Some of the forces built up by deformation of the seal are relieved by the recess 52. When the members are unmated, the nose 70 will exert force on the side walls of the seal which will be transmitted to the base to increase the force on the terminal thereby assuring that the seal will remain in position during unmating.

The present invention may be subject to many modifications and changes without departing from the spirit or essential characteristics thereof. The present embodiment is therefore to be considered in all respects as illustrative and not restrictive of the scope of the invention.

What is claimed is:

1. An improved sealing means for high voltage electrical connectors to provide sealing interfaces between a tubular portion of one rigid mating connector member received in a corresponding cylindrical recess of a mating rigid connector member, said sealing means comprising:

a unitary member of resilient material having a substantially cylindrical configuration and adapted to be received within said recess of said mating connector member and accept said tubular portion therein, at least one inwardly directed annular recess formed on the exterior of the sealing means, an inwardly directed annular portion at one end of said member defining an aperture of lesser diameter than the remainder of the cylindrical configuration, said annular portion having substantially the same width as said annular recess, whereby said at least one annular recess allows for deformation and expansion of said member and said reduced diameter portion without lessing the sealing effect achieved by said sealing means.

2. An improved sealing means according to claim 1 further comprising:

an annular flange extending outwardly from the opposite end of said cylindrical configuration from said annular portion, said flange engaging a mating face of said rigid connector member.

3. An improved sealing means according to claim 2 further comprising:

at least one inwardly directed annular restriction in said cylindrical configuration each aligned with a respective annular recess, whereby said recesses provide stress relief for said annular restriction when connector members are mated.

4. An improved sealing means according to claim 1 wherein said at least one annular recess is closely adjacent to said inwardly directed annular portion whereby compression on the cylindrical configuration of said sealing means will be translated to a constriction of said annular portion.

5. An improved sealing means for high voltage electrical connectors to provide sealing interfaces between a tubular portion of one rigid mating connector member received in a corresponding recess of a mating rigid connector member, said sealing means comprising:

a unitary member of resilient material having a cylindrical configuration including a blind bore closed by an end wall and adapted to be received within said recess of said mating connector member and accept said tubular portion therein, at least one inwardly directed annular restriction in said bore, a like number of annular recesses each aligned on the exterior of the sealing means with a respective annular restriction, a reduced diameter portion at the blind end of said bore, said portion being of lesser diameter than the remainder of the bore, and a corresponding annular recess on the exterior of said sealing means aligned with said portion and being of substantially the same width, whereby said exterior recesses allow for deformation and expansion of said restrictions and said reduced diameter portion without lessing the sealing effect achieved by said sealing means.

6. An improved sealing means according to claim 5 wherein:

said member has a length substantially the same as the recess of the respective rigid connector member.

7. An improved sealing means according to claim 5 further comprising:

an annular flange extending outwardly from the open end of said cylindrical configuration, said flange engaging a mating face of said rigid connector member.

8. An improved sealing means according to claim 5 wherein:

two annular restrictions are formed in spaced relationship with each other and with said reduced diameter portion.

* * * * *